United States Patent [19]

Larsen

[11] 4,085,593

[45] Apr. 25, 1978

[54] STEAM POWER PLANT WITH FLUIDIZED BED HEAT SOURCE FOR SUPERHEATER AND METHOD OF PRODUCING SUPERHEATED STEAM

[75] Inventor: Gunnar Larsen, Finspong, Sweden

[73] Assignee: Stal-Laval Turbin AB, Finspong, Sweden

[21] Appl. No.: 720,527

[22] Filed: Sep. 7, 1976

[30] Foreign Application Priority Data

Sep. 12, 1975 Sweden ..... 7510165

[51] Int. Cl.[2] ..... F01K 3/24

[52] U.S. Cl. ..... 60/676; 122/4 D

[58] Field of Search ..... 60/653, 676, 670; 122/4 D

[56] References Cited

U.S. PATENT DOCUMENTS

| | | | |
|---|---|---|---|
| 2,755,782 | 7/1956 | Campbell | 122/4 D |
| 2,818,049 | 12/1957 | Blaskowski | 122/4 D |
| 3,687,115 | 8/1972 | Bell | 122/4 D |
| 3,884,193 | 5/1975 | Bryers | 122/4 D |

*Primary Examiner*—Allen M. Ostrager
*Attorney, Agent, or Firm*—Pollock, Vande Sande & Priddy

[57] ABSTRACT

A steam power plant is disclosed in which superheaters for the various turbine stages include heat exchange coils located in the bed portion of high temperature fluidized beds. Improved heat transfer and reduced corrosion of the superheater coils are achieved. A method of producing superheated steam without high temperature corrosion is also disclosed.

10 Claims, 1 Drawing Figure

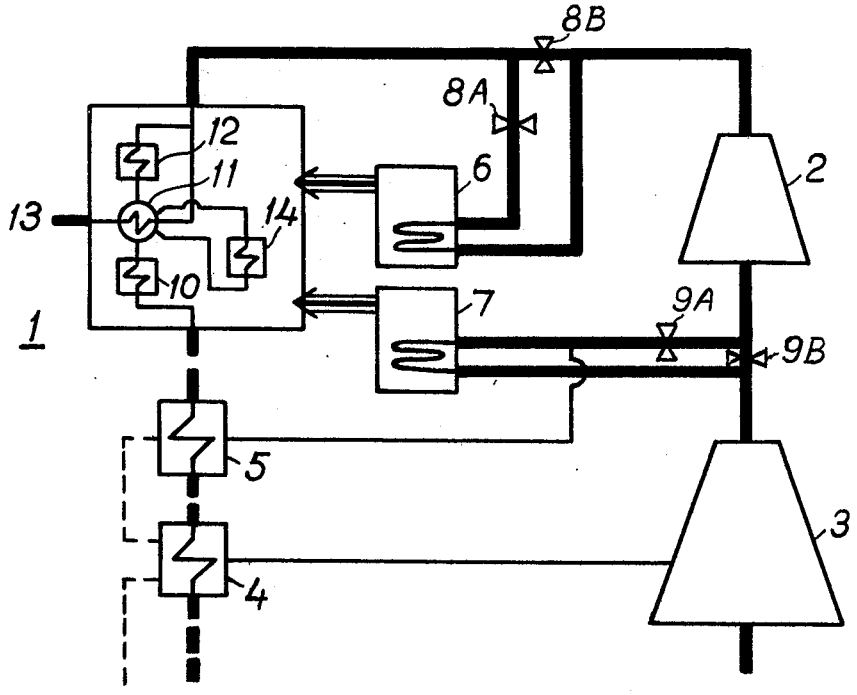
8B
8A
12
11
6
2
13
14
10
7
9A
1
9B
5
3
4

STEAM POWER PLANT WITH FLUIDIZED BED HEAT SOURCE FOR SUPERHEATER AND METHOD OF PRODUCING SUPERHEATED STEAM

BACKGROUND OF THE INVENTION

In power plants of the type comprising a boiler with an integral superheater, a turbine and a separate superheater between the turbine and the integral superheater, it is desirable to drive the superheating of the steam as high as possible to achieve a high thermal efficiency and good heat economy. However, problems have been experienced in prior art plants when the temperature of the steam considerably exceeds 500° C. Under such conditions, ashes from the flue gases passing through the superheaters frequently contain vanadates and other compounds with low melting points which are extremely corrosive in the molten condition. Such molten compounds cause coatings to form on the tubular walls of the superheater and there give rise to high-temperature corrosion. A practical upper temperature limit in the case of oil fired boilers has been found to be around 540° C.

OBJECTS OF THE INVENTION

An object of the invention is to provide a steam power plant having superheaters which are protected from the corrosive effects of compounds entrained in the gases heating the superheater, whereby higher superheat temperatures are attainable.

Another object of the invention is to provide such a power plant in which the superheaters are provided with separate sources of heat in the form of fluidized beds.

A further object of the invention is to provide such a power plant with fluidized beds for the superheaters, in which the exhaust gases from the beds are conveyed to the conventional boiler of the system for exchanging heat therein.

Yet another object of the invention is to provide such a power plant in which the superheaters and their associated fluidized beds may be easily removed from the system to permit conventional operation.

Still another object of the invention is to provide a method of producing high superheat steam without high temperature corrosion.

These objects of the invention are given only by way of example. Thus, other advantages and desirable objects inherently achieved by the disclosed structure may occur to those skilled in the art. Nonetheless, the scope of the invention is to be limited only by the appended claims.

SUMMARY OF THE INVENTION

In order to avoid the corrosion problem experienced with prior art and thereby to enable superheating in excess of 540° C, the superheaters according to the invention are provided with a separate heat source in the form of a fluidized bed located separate from the conventional boiler. In contrast to conditions in the combustion gases in a common steam boiler, it is possible in such a fluidized bed to reduce the formation of corrosive compounds on the superheater tubes and to capture and essentially neutralize the ashes within the bed material. In a fluidized bed used in accordance with this invention, the ashes from the flue gases are precipitated in powdered form and continuously mixed with the bed materials so that they have little tendency to form coatings on the superheater tubes. Should coatings begin to form, they are quickly rubbed off due to the movement of the bed material. Thus, the high temperature ash has little time to cause the corrosion noted in the prior art, so that much higher superheat temperatures become feasible with the invention.

BRIEF DESCRIPTION OF THE DRAWING

The FIGURE shows a partial, schematic representation of a multi-stage steam power plant embodying superheaters in accordance with the present invention.

DESCRIPTION OF THE PREFERRED EMBODIMENT

The single FIGURE shows a steam boiler 1 which delivers steam to a high pressure turbine 2 and an intermediate pressure turbine 3. From intermediate pressure turbine 3 the steam is passed to a low pressure turbine (not shown) with an associated condenser (also not shown). The condensate is passed through certain apparatus and low-pressure preheaters (not shown) and is returned to boiler 1 through high-pressure preheaters 4 and 5 which are heated by the discharge steam from the intermediate pressure turbine 3 and the high-pressure turbine 2.

In addition to a conventional boiler section 14, steam boiler 1 may comprise an economizer 10, a steam dome 11 and an integral superheater 12. Steam dome 11 may possibly house a heat-exchanger for cooling auxiliary steam which, from an output located downstream of integral superheater 12, is conducted to an outlet 13. Alternatively, re-cooled steam may be produced by cooling steam from an output located downstream of integral superheater 12 by spraying in feed water, in the manner familiar to those skilled in the art.

According to the invention, a separately heated superheater 6 is included between steam boiler 1 and high pressure turbine 2; and superheater 7, between high pressure turbine 2 and intermediate pressure turbine 3. The tubes of superheaters 6 and 7 are immersed in fluidized beds for cooling the beds. The fluidized bed used to heat superheater tubes 6 and 7 is of a conventional type fired with common fuel oil. Representative examples of fluidized beds which may be used in accordance with the teachings of this invention are shown in U.S. Pat. Nos. 3,466,012 and 3,924,402. Combustion air at pressure usually just above atmospheric and temperature in the range of 200°–300° C is admitted to the bed for burning the fuel. The flow rate of the combustion air is adjusted as necessary to keep the material fluidized without carrying it out of the bed and away from the combustion chamber. Bed materials such as silicon oxide with a maximum particle size of 3 to 6 mm are suitable for use in the invention. The superheater tubes are preferably of a high strength material such as Incaloy 800, suitable to withstand pressure of up to 130 atmospheres and temperatures of 600°–800° C. Due to the use of a fluidized bed for superheaters 6 and 7, it is possible to achieve highly efficient heat transfer from the combustion gases via the bed material to the tubes, resulting in a superheating to 700° C or more without any of the disadvantages, for example in the form of high-temperature corrosion, which occur in boilers with common combustion devices and heating chambers. Uniform bed temperatures of 900° C are attainable. The combustion in the fluidized bed is controlled using familiar techniques so that a constant superheating temperature is reached.

The power plant is constructed so that, in the case of operational difficulties, unplanned stoppages or particular operating conditions, the superheater 6 and/or the intermediate superheater 7 can be by-passed and shut down by closing valves 8A and 9A and opening valves 8B and 9B so that steam boiler 1 and the turbine machinery including the high-pressure turbine 6 and the intermediate pressure turbine 7 and other auxiliary turbines and steam-driven apparatus present in the power plant can be used without difficulty as before.

The exhaust gases from the fluidized beds 6 and 7 have a temperature of as much as 850° C and are suitably conducted to steam boiler 1, which preferably comprises structure (not shown) permitting optimal use of these off-gases. Steam boiler 1 should also have sufficient capacity to be able to meet the steam requirements which arise in particular operational cases when the fluidized beds 6 and 7 are shut off and thus do not provide any additional heat for the steam boiler 1.

Finally, it is worth emphasizing that the fluidized bed used in the invention has very good heat transmission properties, a fact which, together with the preferred location of the fluidized bed superheaters 6 and 7 between the steam boiler and the turbines, gives a minimum consumption of high-alloyed steel in the superheaters and the conduits for superheated steam to the turbines 2 and 3. Thus, the device produces optimum additional superheat and reduced high temperature corrosion at optimally minimized additional expense.

The invention having been described in sufficient detail to enable one skilled in the art to make and use it, what is claimed is:

1. A steam generating plant for a turbine machine comprising (a) a steam boiler;

(b) a superheating means comprising at least two stages;

(c) the first of said stages being integral with said steam boiler and being heated from a common heat source therewith;

(d) the second of said stages being heated separately in a fluidized bed;

(e) the first of said stages comprising means for heating steam up to a maximum of 540° C; and (f) the second of said stages comprising means for heating said steam above 540° C.

2. A steam generating plant according to claim 1, wherein said turbine machine comprises first and second stages, and wherein said superheating means comprises a third stage heated in a fluidized bed and inserted between said two turbine stages.

3. A steam generating plant according to claim 2, wherein said first turbine stage comprises a high pressure section and said second turbine stage comprises an intermediate pressure section, said second stage of said superheating means being located in said fluidized bed between said steam boiler and said high pressure section.

4. A steam generating plant according to claim 1, wherein the off-gases from said second stage of said superheating means are conducted to said steam boiler to contribute to the heating therein.

5. A steam generating plant according to claim 2, wherein the off-gases from said second and third stages of said superheating means are conducted to said steam boiler to contribute to the heating therein.

6. A steam generating plant according to claim 1, further comprising means for isolating said second stage of said superheating means and by-passing steam from said steam boiler directly to said turbine machine.

7. A steam generating plant according to claim 2, further comprising means for isolating said second and/or third stage of said superheating means and by-passing steam from said steam boiler to said turbine sections.

8. A steam generating plant according to claim 4, further comprising means for isolating said second stage of said superheating means and by-passing steam from said steam boiler directly to said turbine machine.

9. a steam generating plant according to claim 5, further comprising means for isolating said second and/or third stage of said superheating means and by-passing steam from said steam boiler to said turbine sections.

10. A method of producing a high degree of superheat in steam for a steam generating plant, comprising the steps of:

generating steam in a conventional boiler;

passing said steam from said conventional boiler through a supplemental superheater coil; and heating said steam to above 540° C as it passes through said supplemental superheat coil by subjecting said coil to heat from a fluidized bed.

* * * * *